United States Patent [19]

Wild et al.

[11] 3,955,334

[45] May 11, 1976

[54] PROCESS AND APPARATUS FOR SUPPLYING POUCH-LIKE CONTAINERS TO A FILLING STATION

[75] Inventors: Rudolf Wild, Eppelheim; Gerhard Kucherer, Heidelberg; Friedrich Stumpf, Mechesheim, all of Germany

[73] Assignee: Indag Gesellschaft fur Industrieberdarf, Heidelberg, Germany

[22] Filed: Mar. 26, 1974

[21] Appl. No.: 454,970

[30] Foreign Application Priority Data

Mar. 30, 1973 Germany ..... 2315896

[52] U.S. Cl. ..... 53/29; 53/188; 53/384; 53/386

[51] Int. Cl.[2] ..... B65B 43/30; B65B 43/32; B65B 43/22; B65B 43/18

[58] Field of Search ..... 53/29, 36, 187, 188, 53/191, 35, 384, 386, 374

[56] References Cited

UNITED STATES PATENTS

| | | | |
|---|---|---|---|
| 2,288,603 | 7/1942 | Berch | 53/188 X |
| 2,722,358 | 11/1955 | Wilson | 53/188 X |
| 2,899,786 | 8/1959 | Harker | 53/187 |
| 3,323,280 | 6/1967 | Rausch | 53/386 X |
| 3,340,679 | 9/1967 | Johnson | 53/187 X |
| 3,381,447 | 5/1968 | Ash et al. | 53/386 X |
| 3,485,008 | 12/1969 | Silver | 53/374 X |
| 3,568,402 | 3/1971 | Lense et al. | 53/384 |
| 3,676,977 | 7/1972 | Rothmann et al. | 53/188 X |
| 3,750,365 | 8/1973 | Darby, Jr. et al. | 53/29 |
| 3,792,565 | 2/1974 | Goransson | 53/386 X |
| 3,844,092 | 10/1974 | Stringer et al. | 53/386 X |

*Primary Examiner*—Travis S. McGehee
*Assistant Examiner*—Horace M. Culver

[57] ABSTRACT

An arrangement for supplying pouch-like containers to a filling station of a filling and closing machine, includes a magazine for holding the containers in collapsed form, and an arrangement for removing the containers from the magazine and conveying them in an upright position with their open sides upwardly to a filling station, where the containers are opened by opposed suction members which grip two opposite walls and spread them apart. A device is provided for forming a longitudinal crease in the collapsed containers between the magazine and the conveyor.

5 Claims, 4 Drawing Figures

PROCESS AND APPARATUS FOR SUPPLYING POUCH-LIKE CONTAINERS TO A FILLING STATION

BACKGROUND OF THE INVENTION

1. Field of the Invention

The invention relates to a process for supplying pouch-like containers to a filling station, especially for supplying beverage containers to the filling station of a filling and closing machine, and also to an arrangement for carrying out such a process.

2. The Prior Art

In the beverage industry more and more throw-away packages are coming into use. Pouch-like containers especially enjoy a great popularity and have become popular as small packages for milk, fruit juices and other beverages.

In contrast to the bottle-like packages of wax impregnated paper which have been in use for years, especially for milk and mixed milk beverages, but also occasionally for non-alcoholic beverages, there is the question here of pouch-like containers formed of very flexible thin-walled materials, which only have a very slight inherent stability. Typical pouch packages of this type are shown in German patent No. 1,281,140 and Gebrauschsmuster, No. 1,786,749.

One of the problems arising with such pouch packages lies, because of the low stiffness of the materials which form the pouches, in the slight rigidity of the pouches, which defect has been sought to be cured through different type shaped packages. Despite these difficulties the supply of such containers to a filling arrangement, especially the filling station of a filling and closing machine, has been found quite difficult.

SUMMARY OF THE INVENTION

The present invention has the purpose of providing a practical process for feeding pouches to a filling arrangement as well as an apparatus for carrying out this process, wherein the process and apparatus must answer the difficulties of large quantity filling.

In connection with the process, the stated purpose of the invention is solved in that the containers are taken out from a magazine with their flat sides against one another, provided with creases in the area of their long sides, supporting the bottoms of the containers in substantially upright position with their open sides upwardly and conducting them to a filling station and in the latter opening them by suction devices which engage the opposite flat sides in the area of the filling opening and spread apart the flat sides.

An advantageous feature of the process according to the invention is that the pouch-like containers in conjunction with the withdrawal from a magazine are provided approximately in the middle of their width with at least one longitudinal crease, whereby the inherent stability of the pouch is increased in a similar way as, by a middle longitudinal fold, the stiffness of a paper sheet is increased.

A further characteristic of the process according to the invention is that in the filling station in the area of the open sides of the containers and on the longitudinal edges of the container a spreading pressure is applied for spreading apart the opposite sides of the container. This arrangement can, as a further improvement of the invention, be accomplished while transferring the container to the filling station by pressing together the container sides in the area of the open container side progressively up to a predetermined distance apart, the amount of the compression exceeding the width of the spreading apart of the flat surfaces at the open end of the container. A special advantage for the carrying out of the foregoing method is that the container is conducted to the filling station with the flat sides of the container essentially perpendicular to the direction of travel.

With reference to the apparatus for supplying pouch-like containers to a filling station, the purpose of the invention is achieved in that the containers are stored in a magazine in a folded together condition with the flat sides against each other, and an arrangement is provided for taking the container out of the magazine, means for conveying the container to the filling station in upright position and suction means for gripping the container on two surfaces adjacent the open end for spreading apart the flat surfaces into an open container end.

A modification of the arrangement according to the invention is characterised in that the means for transferring the container to the filling station with the container pouches standing upright includes receiving pockets with upwardly open sides. The means for conveying the container to the filling station may be a moving conveyor, on which container pockets are arranged transverse to the direction of travel of the conveyor and whose upwardly lying supporting surfaces in general extend in a straight line between the storage magazine and the filling station.

Another characteristic of the arrangement is that it has guide rails, which before and in the area of the filling station limit the width of the container and engage the longitudinal edges of the containers in the neighborhood of their open sides, wherein the distance of the guide rails from one another in a direction towards the filling station are such that it is originally greater than the container breadth, and is decreased to a considerably reduced, predetermined amount.

Furthermore, equally to another feature, a folding arrangement for the pouch-like containers between the arrangement for removing folded containers from the storage magazine and the means for conveying them to the filling station is arranged by means of which, directly after the movement of the pouch-like containers with their flat sides lying one against the other from the magazine and before the entry of the containers into the means for conveying them to the filling station, the pouches are provided with longitudinal creases parallel to the longitudinal edges. An advantageous and simple arrangement for producing such a crease is characterised by rolls which grip the container approximately in the middle of its wide side, pass through in the longitudinal direction the containers coming from the magazine and thereby provide them with creases in the form of slightly pressed longitudinal grooves.

BRIEF DESCRIPTION OF THE DRAWINGS

In the following the characteristics, advantages and special features of the invention will be described in connection with the accompanying drawings which schematically show an example of an arrangement for conveying pouch-like containers to a filling station of a filling and closing machine.

In the drawings.

DESCRIPTION OF THE PREFERRED EMBODIMENTS

Figure 1:
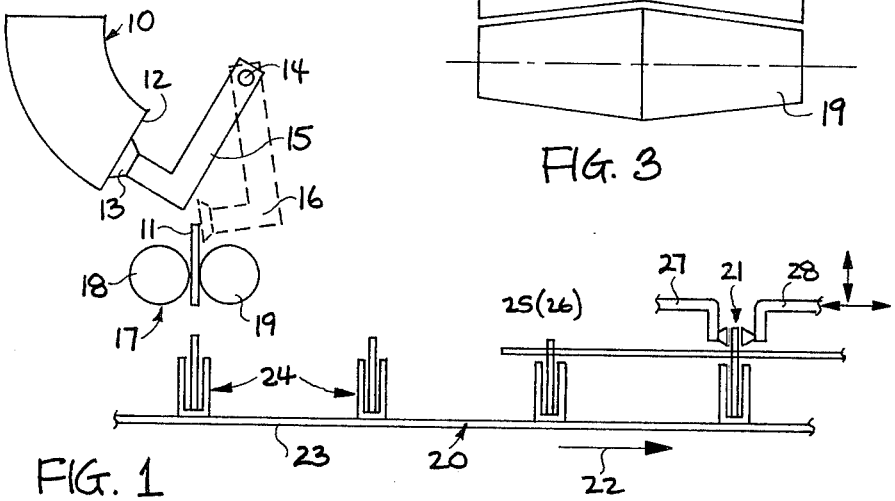
FIG. 1 shows the removal of beverage pouches from a storage magazine with their flat sides lying against one another, the transfer of a pouch to a conveyor provided with receiving pockets as well as the means for spreading apart the open container sides in a filling station.
Figure 3:
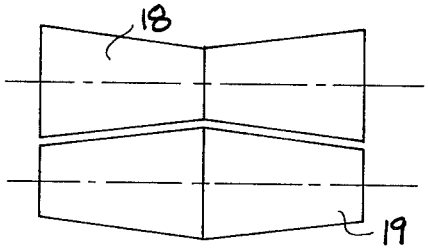
FIG. 3 shows in plan view the view the conveyor provided with receiving pockets for the beverage container and carrying it to the filling station, and the guide rails which spread apart the open end of the container.

The storage magazine 10, which supplies the beverage pouches folded together with their flat sides lying against each other has an open side 12 in which in a known way by means of a suction device 13, which is swingable on the end of a lever arm 15 about an axis 14, is arranged. The folded together beverage pouches 11 have their axes so arranged in the storage magazine 10 that the open side is upward when a container is taken from the magazine. The lever arm 15 is swingable between the remover position shown in FIG. 1 and a position shown in broken lines, at 16, and is movable back and forth between these positions. Below the supply position shown at 16 there is a folding arrangement 17, which receives the folded pouches from the suction device 13, and consists of pouch-transferring downward turning friction rollers 18,19. For guiding the containers in the area of the folding arrangement 17 there may be guides, not shown.

By passing through the folding arrangement 17 consisting of the friction rolls 18,19 the beverage container is impressed in its side surfaces with an intermediate fold corresponding to the shape of roll 19 and parallel to the longitudinal edge of the container, somewhat in the manner of a center crease for improving the stability of a sheet of paper.

Below the folding arrangement 17 a conveyor arrangement 20 extends in the direction of the filling station 21, which can for example be constituted as a traveling chain conveyor. The travel direction is indicated by the arrow 22. The conveyor has a conveying surface 23 extending from the area of the folding arrangement 17 to the filling station 21 provided with upwardly open receiving pockets 24. The movement of the conveyor arrangement is so coordinated with that of the swinging lever which carries the suction device 13 that, during the transfer of a pouch 11 released from the suction device through the folding arrangement 17 to the conveyor, a receiving pocket 24 moves through beneath the folding arrangement, so that the beverage container after passing through the folding arrangement downwards drops in an upright position into the corresponding receiving pocket of the conveyor. Then the conveyor arrangement moves through a distance corresponding to the space between two successive receiving pockets in a direction towards the filling station 21.

In the area of the filling station there are arranged in the path of the beverage containers guide rails 25,26 which engage on both sides the containers, the portions of the container edges which extend above the container receiving pockets in the area of the open container sides and the distance between which is reduced in a direction towards the filling station so that from an amount greater than the breadth of the container it is considerably smaller.

The beverage containers which reach the filling station with their longitudinal edges pressed together by the guide rails 25,16 in the area of the open end of the container are engageable by suction devices 27,28, movable up and down and towards and from each other, which grip the flat sides of the containers whereupon these suction devices are separated so that the introduction of a device for filling beverage containers through the open container side into the inside of the container is possible.

The receiving pockets 24 are wide enough so that they can contain the filled containers.

Figure 2:
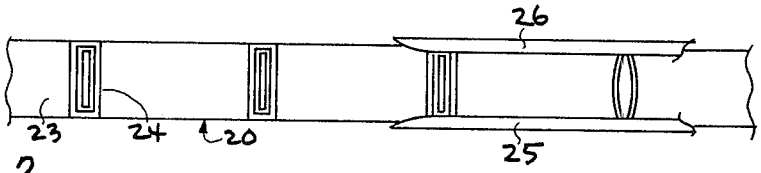
FIG. 2 shows the rolls for producing the grooved fold in plan view.
Figure 4:
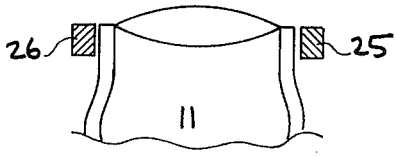
FIG. 4 shows in horizontal cross-section a container between the rails.

FIG. 2 shows at the left the containers in the holders 24 moving towards the right, between the guide rail 25,26. One of the containers is squeezed to open its mouth as shown at the right of the guide rails.

We claim:

1. In a method for filling pouches of flexible sheet material, the improvement comprising feeding the pouches from a stack in which the broader sides of adjacent pouches lie next to each other, and during said feeding step forming at least one intermediate crease in the broader sides of the pouches parallel to the longitudinal edges thereof, transferring the creased pouches in upright position in a path towards a filling station with the broader sides of the pouches lying crosswise of the path while supporting the bottom edges of the pouches, conducting the pouches in said path between spaced rails which decrease in distance from each other thereby pressing the upper ends of the side edges of the pouches during movement in said path towards each other so as to open the upper ends of the pouches, gripping the opposite surfaces of the broader sides of the pouches suctionally at the filling station and spreading the broader sides apart.

2. In an apparatus for filling pouches of flexible material, the improvement comprising means for feeding pouches having closed bottoms from a stack in which the pouches lie with the broader sides of adjacent pouches next to each other, means to form at least one intermediate crease in the broader side of the pouches parallel to the longitudinal edges thereof, a filling station, a plurality of receiving pockets to transfer the creased pouches in upright position in a path towards the filling station with the broader sides of the pouches lying crosswise of the path, and means for supporting the bottom edges of the pouches during such movement, means adjacent the path engageable with the upper ends of the side edges of the pouches to press the side edges towards each other to open the upper ends of the pouches, said pressing means including in the path of the pouch to the filling station and in an area adjacent to the filling station two limiting rails which engage the longitudinal sides of a pouch carried in said receiving pockets in the neighborhood of the open upper end thereof and the distance from which is decreased by a predetermined degree in the direction from the stack to the filling station, and means at the filling station for suctionally engaging the broader sides and spreading them apart.

3. In an apparatus as claimed in claim 2, the receiving pockets for transferring the pouches (11) to the filling station (21) comprising upwardly open receiving pockets (24).

4. In an apparatus as claimed in claim 3, the means for transferring the pouches to the filling station including a traveling conveyor on which the pouch receiving pockets are arranged perpendicular to the direction of the travel, the upper surface of the conveyor extending in a substantially straight line beneath the stack and the filling station.

5. In an apparatus as claimed in claim 2, the creasing means includes rolls for engaging the pouch substantially in the middle of its broad side as it comes from the stack in the longitudinal direction for forming a slightly impressed longitudinal crease therein.

* * * * *